United States Patent [19]

Brown et al.

[11] 4,363,549

[45] Dec. 14, 1982

[54] ELECTROMECHANICALLY OPERATED FUSER ROLL CLOSURE

[75] Inventors: Leon C. Brown, Boulder, Colo.; Jesse L. Campbell, Tucson, Ariz.; Uscoe J. Fitts, Boulder; Willard L. Gudgel, Longmont, both of Colo.

[73] Assignee: International Business Machines Corporation, Armonk, N.Y.

[21] Appl. No.: 145,084

[22] Filed: Apr. 30, 1980

[51] Int. Cl.[3] ..... G03G 15/20

[52] U.S. Cl. ..... 355/3 FU; 219/216; 355/14 FU; 432/60

[58] Field of Search ..... 355/3 R, 3 SH, 3 FU, 355/14 FU; 432/60, 228; 219/216

[56] References Cited

U.S. PATENT DOCUMENTS

| | | | |
|---|---|---|---|
| 2,342,203 | 2/1944 | Kohler | 118/235 |
| 4,038,026 | 7/1977 | Wada et al. | 432/60 |
| 4,050,803 | 9/1977 | McCarroll | 355/3 R |
| 4,121,089 | 10/1978 | Bishop | 432/60 X |
| 4,142,793 | 3/1979 | Schilling | 355/58 |
| 4,272,666 | 6/1981 | Collin | 355/3 FU X |

OTHER PUBLICATIONS

Gaitten et al., "Pressure Roll Support"; IBM Technical Disclosure Bulletin; vol. 15, No. 12, May 1973, p. 3644.

*Primary Examiner*—Fred L. Braun

*Attorney, Agent, or Firm*—Gregory A. Conley; J. Jancin, Jr.; N. L. Medlock

[57] ABSTRACT

A fuser roll apparatus in a toner fixing station associated with an electrophotographic or xerographic device for fixing a toner image onto a copy sheet by the application of heat and pressure. The fusing apparatus includes a pair of fuser rollers and a linkage mechanism coupling a control cam and the fuser rollers. An electromechanically operated latch, in the form of a solenoid, is interposed in the linkage mechanism coupling the control cam and fuser rollers. So long as the solenoid is energized, the opening of the rollers is controlled solely by the rotation of the cam. If the solenoid is deenergized however, the rollers are maintained in an open position. Thereafter, until the solenoid is again energized, the rollers remain open and are unaffected by rotational movement of the cam.

3 Claims, 3 Drawing Figures

ELECTROMECHANICALLY OPERATED FUSER ROLL CLOSURE

DESCRIPTION

1. Technical Field

This invention relates generally to a fuser roll apparatus in a toner fixing station associated with an electrophotographic or xerographic device and more particularly to such an apparatus wherein an electromechanically operated latch is provided for selectively moving the heated fuser roll and associated backup roll into and out of circumferential engagement.

2. Background Art

In the process of xerography, a light image corresponding to the original to be copied is typically recorded in the form of a latent electrostatic image upon a photoconductive member. This latent image is developed, that is to say, made visible, by the application of a pigmented thermoplastic resin, commonly referred to as toner. The visible image is thereafter transferred from the photoconductive member onto a copy sheet, such as for example, paper. The copy sheet is subsequently passed to a fusing apparatus which affixes the image onto the sheet and is later discharged from the machine as a final copy.

One approach to fixing the toner particles onto the copy sheet has been to pass the copy sheet with toner images thereon through a fusing nip formed by a heated fuser roll and a backup roll. As it passes therethrough, the copy sheet is simultaneously pressed and heated so that the toner becomes softened and firmly attached to the copy sheet.

In such a fusing arrangement, opening and closing of the fuser nip is commonly controlled by a cam rotatable in synchronization with movement of the copy sheets. Frequently therefore, during the processing of variable length sheets (i.e., sheets of different length than the selected standard), the rollers are allowed to remain in contact during periods in which no copy sheet is disposed therebetween. This prolonged direct contact commonly results in the overheating of the backup roll. Such overheating of the roller may result in a paper jam as the copy sheet will tend to follow the backup roll rather than continuing along the intended paper path beyond the fuser station. This backup roll sticking problem is especially aggravated during the fusing of duplex copies (i.e., sheets with toner copy on both sides) due to the cohesive nature of the toner. Overheating of the roller surface may also result in a phenomena referred to in the printing art as "offset" wherein toner adheres to the roller surface and is transferred to the next copy sheet.

Substantial damage may also be caused to the rollers from entrapment of copy sheets between the heated fuser roll and the backup roll when there is a loss of power during a copying operation. It is desirable therefore that the fuser rollers remain in an open position during standby mode and similarly during a copying operation that the fusing nip be closed only when there is paper between the rollers. Thus, it is desirable that the fusing nip be opened during the intersheet gap that may exist between adjacent copy sheets and be closed only when the next sheet arrives. Likewise, when a paper jam is detected, control of the closure mechanism is desirable so that fuser roller opening may be effected and damage to the rollers avoided.

Prior attempts to control the operation of the cam and thereby the opening and closing of the fuser rollers, U.S. Pat. No. 4,038,026 being typical thereof, have utilized a spring clutch in this regard. Such devices, while providing for the interruption of fuser roller closure upon the occurrence of certain conditions, are dependent on the coasting effect of the apparatus. It is necessary therefore, that the clutch act as a single-turn clutch, so that when interrupted, the cam does not stop immediately but rather continues to travel through an angle sufficient to effect the opening of the rollers. Such an arrangement is especially disadvantageous in the case of a loss of power during a copying operation as the machine often will not coast far enough to operate the cam to effect opening of the rollers.

Accordingly, it is a principal object of this invention to provide an improved xerographic toner fixing apparatus.

It is another object of this invention to provide a toner fixing apparatus which allows the operation of heated fuser roll and backup roll opening and closing under mechanical cam control for standard operations, but which permits interruption of the cam closure mechanism upon the occurrence of certain conditions.

Another object of this invention is to provide a toner fixing apparatus which provides for the operation of heated fuser roll and backup roll opening and closing independent of machine coast.

A further object of this invention is to provide a toner fixing apparatus capable of fusing toner images onto a copy sheet without toner offset.

Still another object of this invention is to provide a toner fixing apparatus which avoids fuser roller damage caused by copy sheet entrapment.

DISCLOSURE OF INVENTION

The embodiment disclosed for the present invention provides an improved fuser roller closure mechanism in an electrophotographic or xerographic device having a pair of fuser rollers and a linkage mechanism coupling a control cam and the fuser rollers. In accordance with the invention, an electromechanically operated latch which is a selectively engageable latch, in the form of a solenoid, is interposed in the linkage mechanism coupling the control cam and fuser rollers. The solenoid is arranged so that a portion of its magnetic flux path passes through each of two independently pivotable arms. One of the arms acts as a cam follower and the other is coupled to the fuser rollers. The latter arm effects opening and closing of the fuser nip. So long as the solenoid is energized, the mechanism is controlled solely by the rotation of the cam. If the solenoid is deenergized however, the arms become disconnected (i.e., separated) and the fuser rollers are maintained in an open position. Thereafter, until the solenoid is again energized, the rollers are unaffected by rotational movement of the cam.

BRIEF DESCRIPTION OF THE DRAWING

The invention will now be particularly described by way of example, with reference to the accompanying drawing in which.

BEST MODE FOR CARRYING OUT THE INVENTION

Figure 1:
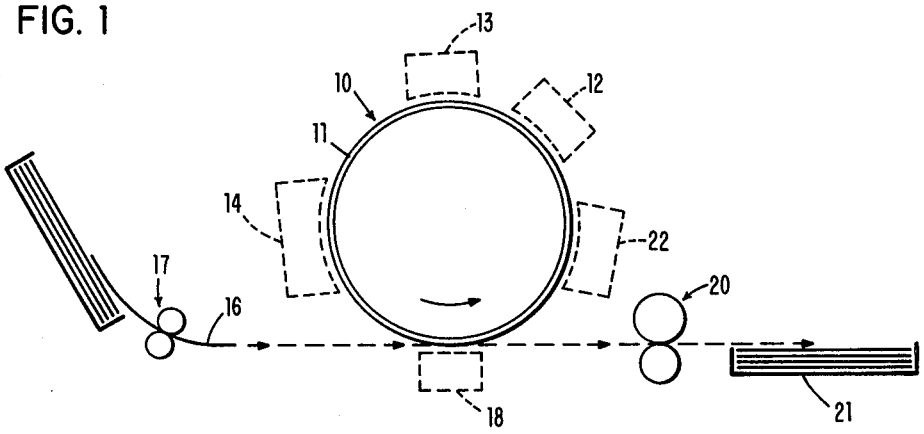
FIG. 1 is a schematic representation of a xerographic copying apparatus having a fuser roller fixing station incorporating the features of the present invention therein.

Referring to FIG. 1, there is depicted schematically, the various components of a typical xerographic copying apparatus in which the features of the present invention may be implemented.

Inasmuch as the art of xerographic copying is well known, the various processing stations for producing a copy of an original document are represented in FIG. 1 in block form, and are defined in terms of functionality.

Still referring to FIG. 1, the xerographic copying apparatus includes a rotatable drum 10 having a photoconductive surface 11. As the drum rotates in a counterclockwise direction, photoconductive surface 11 is caused to pass sequentially through a series of xerographic processing stations.

The first of these stations is a charging station 12 where a uniform electrostatic charge is deposited onto the photoconductive surface.

The second, exposure station 13, includes an exposure mechanism having a stationary housing for supporting the original (i.e., master) document to be copied. At station 13, the original document is scanned by oscillating a mirror (not shown) in a timed relationship with the movement of drum 10 to form a light image thereof. This light image is thereafter projected onto the charged portion of photoconductive surface 11. In this manner, the charge in the exposed areas of surface 11 is dissipated, thereby forming a latent electrostatic image on surface 11 which corresponds to the informational areas of the original document.

The latent electrostatic image recorded on photoconductive surface 11 is then rotated to development station 14. At station 14, xerographic developing material, including toner particles having an electrostatic charge opposite that of the latent electrostatic image, is cascaded over the latent electrostatic image to form a toner powder image on the photoconductive surface.

With continued reference to FIG. 1, a copy sheet 16 is advanced by sheet feeding apparatus 17 to transfer station 18. Sheet 16 is advanced into contact with drum 10 in a timed sequence so that the toner powder image developed on photoconductive surface 11 contacts the advancing copy sheet at transfer station 18. Once the toner powder image is transferred to sheet 16, the sheet is advanced to toner fusing assembly 20, where the toner powder image is permanently affixed to the copy sheet. The detailed operation of the toner fusing assembly will be described hereinafter in greater detail with reference to FIG. 2.

Once the fusing operation is completed, the finished copy sheet passes to an output tray 21. The surface of drum 10 is thereafter cleaned at drum cleaning and discharge station 22 in preparation for the next copy cycle.

Figure 2:
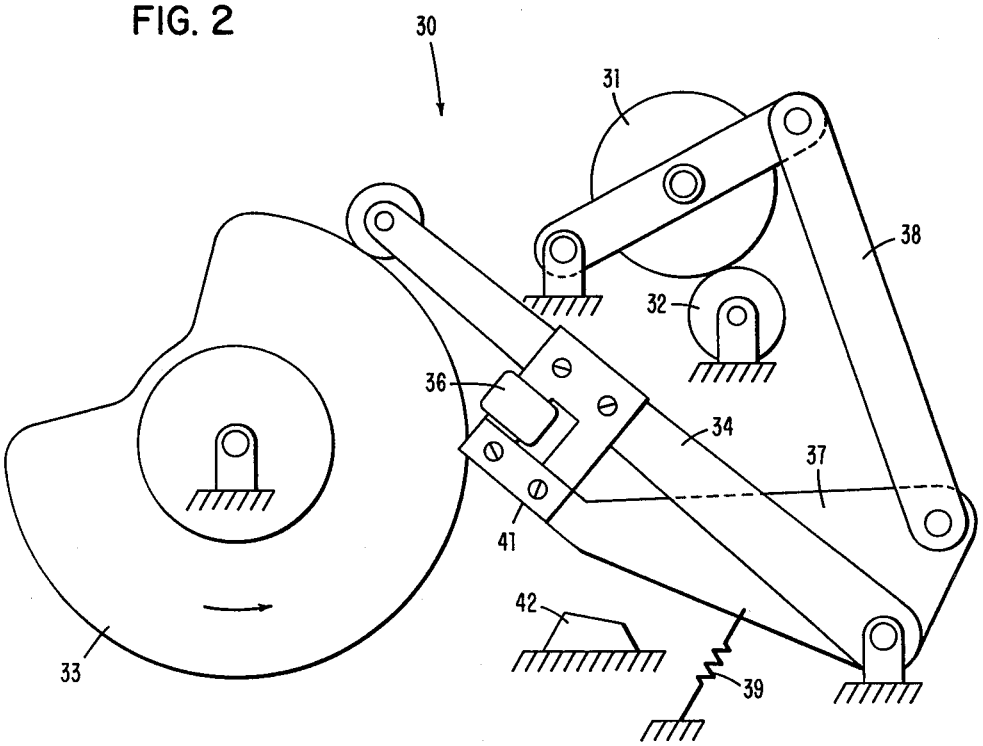
FIG. 2 is a schematic representation of the electromechanically operated latch assembly for selectively moving a heated fuser roll and associated backup roll into and out of circumferential engagement.

Referring now to FIG. 2, fuser assembly 30 includes a heated fuser roll 31 and a backup roll 32. Heated fuser roll 31 cooperates with backup roll 32 to define a fusing nip through which a sheet of copy material having a toner image thereon passes. The copy sheet is so oriented that the side thereof bearing the toner image contacts heated fuser roll 31. The toner image is thereby affixed to the copy sheet. The fusing nip formed by fuser rollers 31 and 32 is designed so as to be capable of being opened and closed under mechanical cam control, the cam 33 being rotatable in synchronization with the movement of the copy sheets relative to the rollers. Pivoted on cam 33 and mounted thereon so as to follow the contour of the cam is follower arm 34 to which solenoid 36 is attached. Also pivoted on the same shaft is lever arm 37 which through linkage 38 is connected so as to be capable of effecting the shifting of the surfaces of backup roll 32 and heated fuser roll 31 between open (i.e., no surface contact) and closed (i.e., surface contact) positions. Spring means 39 are provided for normally biasing fuser rollers 31 and 32 in an open position. Other suitable biasing means may be used to accomplish the same result.

The closed loop magnetic flux path of solenoid 36 includes a portion of follower arm 34 and of lever arm 37. Actuation of solenoid 36 while the magnetic flux path portions of the arms are in proximity to each other, causes lever arm 37 to which armature 41 is attached and follower arm 34 to become fixedly connected. Once connected, the arms move as a unit and further cause backup roll 32 and heated fuser roll 31 to open and close in response to the rotation of cam 33.

It is well known in the xerographic copying art to apply a release agent, such as a silicone oil to the outer surface of the heated fuser roll so as to provide the heated fuser roll with an outer surface which has a relatively low affinity to tackified toner particles. While the use of the silicone oil release agent has eliminated many of the problems associated with the use of the fuser assembly, occasionally, toner particles may be nonetheless offset to the heated fuser roll. As a result, toner particles are transferred to the surface of the heated fuser roll with subsequent transfer to the backup roll during periods when no copy paper is in the nip. Toner particles may also be picked up by the backup roll during fusing of duplex copies. As a result of this toner offset, the copy sheet often becomes wrapped about the backup roll or heated fuser roll, thereby causing jamming due to the cohesive nature of the toner. The fuser apparatus in accordance with the present invention is so designed that when a paper jam is detected, solenoid 36 is deenergized thereby allowing follower arm 34 and lever arm 37 to separate under the force applied by biasing spring 39. Lever arm 37 then moves to stop 42. Deenergization of solenoid 36 thus results in the immediate separation of fuser rollers 31 and 32 by effectively interrupting the cam linkage. Thereafter, until solenoid 36 is again energized, heated fuser roll 31 and backup roll 32 remain in an open position and are unaffected by the rotational movement of the cam.

The interposition of the solenoid in the control linkage in this manner, allows for the selective interruption of the closure mechanism. Thus, during the copying of variable length sheets, opening of the fusing nip during the intersheet gap may be easily effected by deenergization of the solenoid. Put another way, the cam itself is conventional and is designed for paper of the maximum anticipated length. The cam is interconnected mechanically to control opening and closing of the fuser rollers in an appropriately timed relation as such maximum length sheets are fused. Whenever a shorter sheet is being handled, the solenoid is de-energized at a point in time correlated to the actual sheet length being handled. This results in an appropriately earlier fuser roller opening than for the longer sheets. Such opening results in a reduction in the occurrence of overheating of the backup roll and therefore the adverse consequences associated therewith, for example, backup roll sticking. Similarly, the fuser rollers will assume an open position whenever there is a loss of power, as in such a case, the solenoid will be automatically deenergized. The problems of copy sheet entrapment and roller damage, associated therewith, are thereby avoided.

Figure 3:
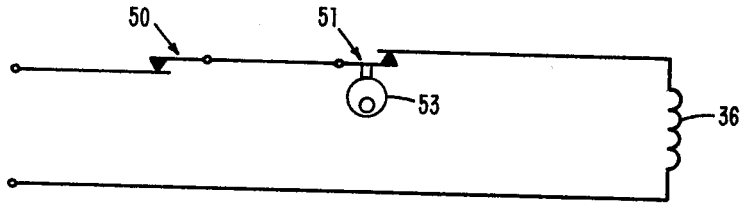
FIG. 3 is a schematic representation of electrical circuitry for controlling the energization of the solenoid of the latch assembly.

The basic circuitry for controlling the energization and deenergization of solenoid 36 to open and close the fuser rollers can include an arrangement of switches such as that shown in FIG. 3. Normally closed switch 50 is employed in the circuit, for example, to deenergize solenoid 36 in response to sensing a paper jam or some other emergency condition for which fuser roller opening is desired. On the sensing of the condition, switch 50 is opened and the solenoid deenergized. Switch 51 is provided so as to be opened and closed cyclically as cam 53 is rotated during machine operation. If this cyclic opening and closing is timed with the rotational movement of cam 33 (see also FIG. 2), solenoid 36 can be deenergized (i.e., switch 51 can be opened) as a function of the position of cam 33.

While the present invention has been particularly described with reference to the preferred embodiment thereof, it will be understood by those skilled in the art that various changes in form and detail may be made therein, without departing from the spirit and scope of the invention.

What is claimed is:

1. A xerographic toner fixing apparatus comprising:

substantially parallel first and second cylindrical fuser rollers;

biasing means for maintaining the peripheral surfaces of said fuser rollers in an open position;

a rotatable cam;

means for rotating said cam;

a linkage mechanism coupling said cam to at least one of said fuser rollers, said linkage mechanism including an electromechanically operated latch and an electrical control means for selectively energizing said electromechanically operated latch;

said linkage mechanism further including means for shifting the peripheral surfaces of said fuser rollers between open and closed positions when said electromechanically operated latch is energized and for retaining said fuser rollers in an open position when said electromechanically operated latch is deenergized.

2. A xerographic copying apparatus comprising:

a pair of fuser rollers;

a rotatable cam;

means for rotating said cam;

a linkage mechanism including first and second arms with said first arm being mounted for following the contour of said cam and said second arm being connected to one of said fuser rollers for shifting the peripheral surfaces of said rollers between open and closed positions;

selectively engageable latch means for selectively coupling said second arm to said first arm when said selectively engageable latch is energized so that said arms are fixedly connected whereby the movement of said second arm follows the movement of said first arm to cause said rollers to open and close in response to the contour of said cam and biasing means for maintaining the peripheral surfaces of said rollers in the open position when said selectively engageable latch is disengaged.

3. A xerographic copying apparatus comprising:

a pair of fuser rollers;

a rotatable cam;

means for rotating said cam;

a linkage mechanism including first and second arms with said first arm being mounted for following the contour of said cam and said second arm being connected to one of said fuser rollers for shifting the peripheral surfaces of said rollers between open and closed positions;

selectively engageable latch means for selectively coupling said second arm to said first arm so that said arms are fixedly connected, said selectively engageable latch further comprising:

electrical solenoid means attached to one of said arms, the closed loop magnetic flux path of said solenoid means including a portion of each of said arms, and means for selectively applying actuation power to said electrical solenoid means;

biasing means for maintaining the peripheral surfaces of said rollers in the open position when said selectively engageable latch is disengaged;

whereby actuation of said solenoid means while said magnetic flux path portions of said arms are in proximity to each other causes said arms to become fixedly connected and to further cause said rollers to open and close in response to the contour of said cam, whereas deactuation of said solenoid means causes said arms to separate and to cause said rollers to remain in the open position.

* * * * *